US012385486B2

(12) United States Patent
Takeda et al.

(10) Patent No.: US 12,385,486 B2
(45) Date of Patent: Aug. 12, 2025

(54) SCROLL COMPRESSOR AND REFRIGERATION DEVICE

(71) Applicant: DAIKIN INDUSTRIES, LTD., Osaka (JP)

(72) Inventors: Jin Takeda, Osaka (JP); Hiroyuki Taniwa, Osaka (JP); Hiroshi Kitaura, Osaka (JP); Yoshinobu Yosuke, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/883,940

(22) Filed: Sep. 12, 2024

(65) Prior Publication Data

US 2025/0003407 A1 Jan. 2, 2025

Related U.S. Application Data

(63) Continuation of application No. PCT/JP2022/048408, filed on Dec. 27, 2022.

(30) Foreign Application Priority Data

Mar. 29, 2022 (JP) ..... 2022-052881

(51) Int. Cl.
*F04C 18/02* (2006.01)
*F25B 31/02* (2006.01)

(52) U.S. Cl.
CPC ..... *F04C 18/0215* (2013.01); *F04C 2240/54* (2013.01); *F25B 31/026* (2013.01)

(58) Field of Classification Search
CPC .. F04C 18/0215; F04C 18/0253; F04C 18/02; F04C 18/0207; F04C 18/0246;
(Continued)

(56) References Cited

U.S. PATENT DOCUMENTS 10,844,856 B2 * 11/2020 Yosuke ..... F04C 27/005
10,851,780 B2 * 12/2020 Yosuke ..... F04C 27/005
(Continued)

FOREIGN PATENT DOCUMENTS

JP 8-42470 A 2/1996
JP 8-261174 A 10/1996
(Continued)

OTHER PUBLICATIONS

International Search Report of corresponding PCT Application No. PCT/JP2022/048408 dated Feb. 14, 2023.
(Continued)

*Primary Examiner* — Dapinder Singh
(74) *Attorney, Agent, or Firm* — GLOBAL IP COUNSELORS, LLP

(57) ABSTRACT

A scroll compressor includes a compression mechanism having a fixed scroll and a movable scroll, and a floating member supporting the movable scroll. The floating member includes an opposing surface opposed to a back surface of the movable scroll. The back surface of the movable scroll includes a first portion facing an inner portion of the opposing surface of the floating member, and a second portion facing an outer portion of the opposing surface of the floating member. A clearance is present between the inner portion of the opposing surface and the first portion of the back surface.

9 Claims, 6 Drawing Sheets

(58) Field of Classification Search
CPC ..... F04C 18/0269; F04C 15/0042; F04C 15/0049; F04C 29/00; F04C 29/0021; F04C 23/008; F04C 2240/54; F25B 31/026; F25B 31/02
See application file for complete search history.

(56) References Cited

U.S. PATENT DOCUMENTS

| | | | | |
|---|---|---|---|---|
| 2019/0178250 | A1* | 6/2019 | DeFord | F04C 18/0215 |
| 2022/0299028 | A1* | 9/2022 | Tanaka | F04C 18/0269 |

FOREIGN PATENT DOCUMENTS

| | | | |
|---|---|---|---|
| JP | 2005-282511 | A | 10/2005 |
| JP | 2020-193576 | A | 12/2020 |

OTHER PUBLICATIONS

International Preliminary Report of corresponding PCT Application No. PCT/JP2022/048408 dated Oct. 10, 2024.
European Search Report of corresponding EP Application No. 22 93 5783.5 dated Mar. 7, 2025.

* cited by examiner

SCROLL COMPRESSOR AND REFRIGERATION DEVICE

CROSS-REFERENCE TO RELATED APPLICATIONS

This is a continuation of International Application No. PCT/JP2022/048408 filed on Dec. 27, 2022, which claims priority to Japanese Patent Application No. 2022-052881, filed on Mar. 29, 2022. The entire disclosures of these applications are incorporated by reference herein.

BACKGROUND

Technical Field

The present disclosure relates to a scroll compressor and a refrigeration apparatus.

Background Art

Japanese Unexamined Patent Publication No. 2020-193576 discloses a scroll compressor. The scroll compressor described in Japanese Unexamined Patent Publication No. 2020-193576 includes a compression mechanism having a fixed scroll and a movable scroll and a floating member. The floating member is pushed up when high pressure and intermediate pressure act on a back surface of the floating member. This causes the floating member to press the movable scroll against the fixed scroll.

SUMMARY

If the movable scroll tilts, the floating member is inclined to follow the tilt of the movable scroll, possibly keeping the floating member in close contact with the movable scroll without any clearance. As a result, oil is less likely to flow into a space between the movable scroll and the floating member, causing poor lubrication. Thus, a contact portion between the movable scroll and the floating member is seized, and bearing reliability of the floating member may decrease.

An object of the present disclosure is to keep the bearing reliability of the floating member from deteriorating although the movable scroll tilts and the floating member follows the tilt of the movable scroll.

A first aspect is directed to a scroll compressor. The scroll compressor includes a compression mechanism having a fixed scroll and a movable scroll, and a floating member supporting the movable scroll. The floating member includes an opposing surface opposed to a back surface of the movable scroll. The back surface of the movable scroll includes a first portion facing an inner portion of the opposing surface of the floating member, and a second portion facing an outer portion of the opposing surface of the floating member. A clearance is present between the inner portion of the opposing surface and the first portion of the back surface.

DETAILED DESCRIPTION OF EMBODIMENT(S)

Figure 1:
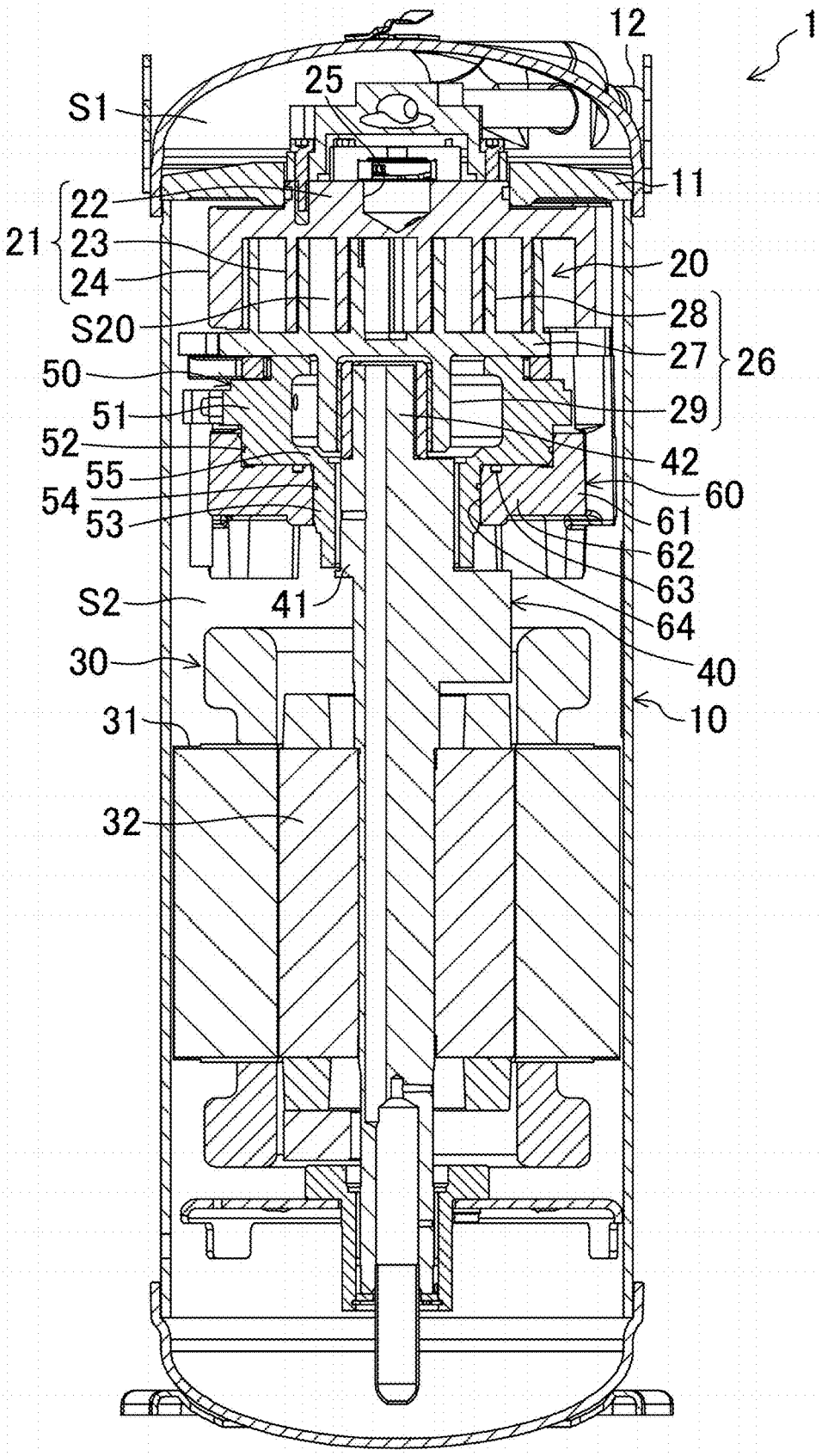
FIG. 1 is a view illustrating a schematic general configuration of a scroll compressor according to an embodiment.

As illustrated in FIG. 1, a screw compressor (1) is provided in a refrigeration apparatus (2). The refrigeration apparatus (2) includes a refrigerant circuit (2*a*) filled with a refrigerant. The refrigerant circuit (2*a*) has a screw compressor (1), a radiator (3), a decompression mechanism (4), and an evaporator (5). The decompression mechanism (4) is, for example, an expansion valve. The refrigerant circuit (2*a*) performs a vapor compression refrigeration cycle.

Embodiments of the present disclosure will be described in detail below with reference to the drawings. The present disclosure is not limited to the embodiments shown below, and various changes can be made within the scope without departing from the technical concept of the present disclosure. Each of the drawings is intended to illustrate the present disclosure conceptually, and dimensions, ratios, or numbers may be exaggerated or simplified as necessary for the sake of ease of understanding.

Exemplary embodiments will be described in detail below based on the drawings.

General Configuration

A scroll compressor (1) will be described with reference to FIG. 1. The scroll compressor (1) is a device that sucks a refrigerant, compresses the sucked refrigerant, and discharges the compressed refrigerant. The refrigerant is, for example, a HFC refrigerant R32. Note that R32 is merely an example of the type of the refrigerant, and the scroll compressor (1) may be a device that compresses and discharges a refrigerant other than R32. The scroll compressor (1) is used for a refrigeration apparatus. The refrigeration apparatus includes any of an air conditioner that adjusts the temperature and humidity of air, a cooling apparatus that cools an internal space of a storage, and a hot water supply apparatus that produces hot water. The scroll compressor (1) is installed in, for example, an outdoor unit of an air conditioner, and constitutes part of a refrigerant circuit of the air conditioner.

As illustrated in FIG. 1, the scroll compressor (1) includes a casing (10), a compression mechanism (20), an electric motor (30), a drive shaft (40), a floating member (50), and a frame (60).

The casing (10) is in the shape of a vertically long cylinder with both ends closed. The casing (10) houses the compression mechanism (20) and the electric motor (30). The drive shaft (40) extending in the casing (10) in an axial direction (Y) (a vertical direction in FIG. 1) connects the compression mechanism (20) and the electric motor (30).

A partitioning member (11) is provided in an upper portion of the casing (10). The partitioning member (11) divides an internal space of the casing (10) into two spaces. A space above the partitioning member (11) constitutes a first space (S1). A space below the partitioning member (11) constitutes a second space (S2).

The casing (10) is provided with a suction pipe (not shown) and a discharge pipe (12). The suction pipe penetrates a barrel of the casing (10) in a radial direction (X) and communicates with the second space (S2). The suction pipe introduces a low-pressure fluid (e.g., a gas refrigerant) into the second space (S2). The discharge pipe (12) penetrates an upper portion of the casing (10) in the radial direction (X) to communicate with the first space (S1). The discharge pipe (12) leads a high-pressure fluid in the first space (S1) to the outside of the casing (10).

The compression mechanism (20) includes a fixed scroll (21) and a movable scroll (26). The fixed scroll (21) is fixed to the frame (60). The movable scroll (26) is disposed between the floating member (50) and the fixed scroll (21). The movable scroll (26) is configured to mesh with the fixed scroll (21) and rotate eccentrically relative to the fixed scroll (21).

The fixed scroll (21) is disposed on one side (in this example, an upper side) of the frame (60) in the axial direction (Y). The fixed scroll (21) includes a fixed end plate (22), a fixed wrap (23), and an outer peripheral wall (24).

The fixed end plate (22) has a substantially circular plate shape. The fixed wrap (23) is formed in the shape of a spiral wall that shows an involute curve, and protrudes from a front surface (a lower surface in this example) of the fixed end plate (22). The outer peripheral wall (24) surrounds the outer periphery of the fixed wrap (23), and protrudes from the front surface of the fixed end plate (22). A distal end face (a lower end face in this example) of the fixed wrap (23) is substantially flush with a distal end face of the outer peripheral wall (24).

An inlet (not shown) is formed in the outer peripheral wall (24) of the fixed scroll (21). The inlet communicates with the second space (S2). The fixed end plate (22) of the fixed scroll (21) is provided with an outlet (25) penetrating a center portion of the fixed end plate (22) in a thickness direction.

The movable scroll (26) includes a movable end plate (27), a movable wrap (28), and a boss (29).

The movable end plate (27) has a substantially circular plate shape. The movable wrap (28) is formed in the shape of a spiral wall that shows an involute curve, and protrudes from a front surface (an upper surface in this example) of the movable end plate (27). The boss (29) is formed in a cylindrical shape, and disposed at a center portion of a back surface (270) (a lower surface in this example) of the movable end plate (27). The movable wrap (28) of the movable scroll (26) meshes with the fixed wrap (23) of the fixed scroll (21).

This configuration forms a compression chamber (S20) between the fixed scroll (21) and the movable scroll (26). The compression chamber (S20) is a space for compressing a fluid. The compression chamber (S20) is configured to compress a fluid sucked through the suction pipe, the second space (S2), and the inlet, and discharge the compressed fluid through the outlet (25).

The electric motor (30) is housed in the casing (10), and is disposed below the compression mechanism (20). The electric motor (30) includes a stator (31) and a rotor (32). The stator (31) is substantially in the shape of a cylinder, and is fixed to the casing (10). The rotor (32) is rotatably inserted into, and runs through, the stator (31). The drive shaft (40) is inserted in the rotor (32) and fixed to an inner periphery of the rotor (32).

The drive shaft (40) has a main shaft portion (41) and an eccentric shaft portion (42). The main shaft portion (41) extends in the axial direction (Y) (the vertical direction in this embodiment). The axial direction (Y) is parallel to a direction in which the axis of the main shaft portion (41) of the drive shaft (40) extends. The eccentric shaft portion (42) is provided at an upper end of the main shaft portion (41). The eccentric shaft portion (42) has a smaller outer diameter than the main shaft portion (41). The eccentric shaft portion (42) has an axis decentered by a predetermined distance with respect to the axis of the main shaft portion (41). The drive shaft (40) is connected to the movable scroll (26) from the other side (Y2) in the axial direction (Y) (from a lower side in this embodiment).

The floating member (50) is formed substantially in a cylindrical shape. The floating member (50) is supported in a swingable manner. The floating member (50) includes a scroll support (51), a shaft support (53), and a coupling portion (55). The floating member (50) is an example of a thrust bearing of the present invention. A space W exists between an outer circumference of the boss (29) and the floating member (50).

The scroll support (51) is a substantially cylindrical portion that makes contact with the back surface (270) of the movable scroll (26). The scroll support (51) supports the movable scroll (26). A first annular groove (52) that houses an O-ring (not shown) is formed in an outer wall of the scroll support (51) near its lower end.

The shaft support (53) is a substantially cylindrical portion having a smaller inner diameter than the scroll support (51). The shaft support (53) rotatably supports the main shaft portion (41) of the drive shaft (40). A second annular groove (54) that houses an O-ring (not shown) is formed in an outer wall of the shaft support (53) near its lower end.

The coupling portion (55) is a substantially ring-shaped portion. The coupling portion (55) couples the lower end of the scroll support (51) and the upper end of the shaft support (53) to each other.

The floating member (50), the movable scroll (26), and the fixed scroll (21) are arranged in this order toward the one side (Y1) in the axial direction (Y).

The frame (60) is substantially cylindrically shaped. The frame (60) is fixed to the casing (10) in the second space (S2) by, for example, press fitting. The frame (60) includes a fixing portion (61) and a protrusion (62).

The fixing portion (61) is a substantially cylindrical portion. An outer peripheral surface of the fixing portion (61) is fixed to the casing (10). The fixed scroll (21) is fixed to an upper surface of the fixing portion (61).

The protrusion (62) is a substantially cylindrical or ring-shaped portion. The protrusion (62) protrudes inward in the radial direction (X) from the inner periphery of the fixing portion (61). A third annular groove (63) that houses a seal member (not shown) is formed in an upper surface of the protrusion (62) near its inner periphery.

A through hole (64) is formed inside the protrusion (62) in the radial direction (X). The drive shaft (40) and the shaft support (53) are inserted into the through hole (64). Operation of Scroll Compressor As illustrated in FIG. 1, when electric power is supplied to the electric motor (30), the rotor (32) of the electric motor (30) rotates to drive the drive shaft (40) to rotate. When the drive shaft (40) is driven to rotate, the movable scroll (26) coupled to the drive shaft (40) rotates eccentrically with respect to the fixed scroll (21). Thus, the low-pressure fluid is sucked into the compression chamber (S20) through the suction pipe and the second space (S2) to be compressed in the compression chamber (S20). The compressed fluid is discharged from the discharge pipe (12) through the outlet (25) and the first space (S1). The compressed fluid flows from the third annular groove (63) to a first space (a space between the second annular groove (54) and the third annular groove (63)). A high pressure (high pressure) is generated in the first space, and the high pressure presses the movable scroll (26) toward the fixed scroll (21) via the floating member (50). The fluid in the course of compression is introduced from the compression chamber (S20) to a second space (a space between the first annular groove (52) and the third annular groove (63)). In the second space, a slightly high pressure (intermediate pressure) is generated, and the intermediate pressure presses the movable scroll (26) toward the fixed scroll (21) via the floating member (50).

First Embodiment

Figure 2A:
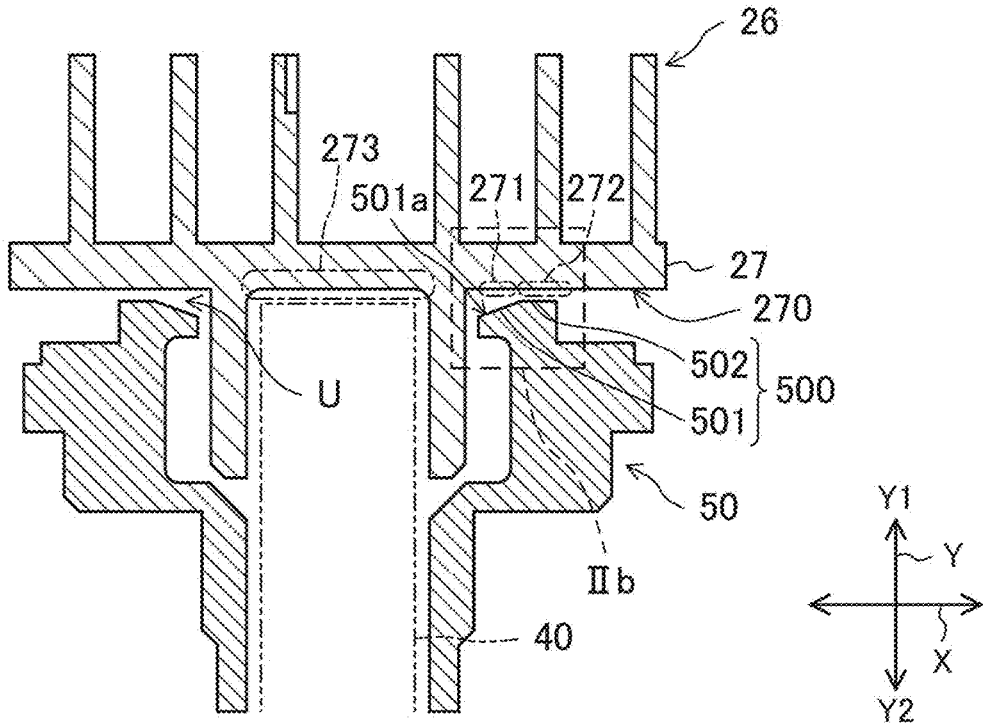
FIG. 2A is a sectional end view illustrating a first embodiment of a configuration of a movable scroll and a floating member.
Figure 2B:
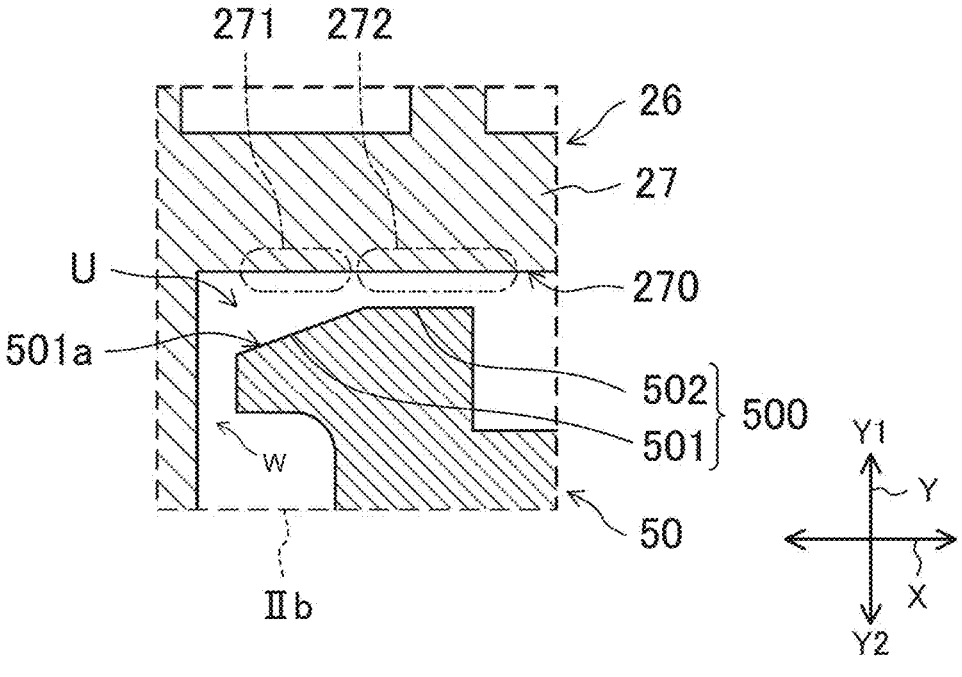
FIG. 2B is a partially enlarged view of FIG. 2A.

A first embodiment of the configuration of the movable scroll (26) and the floating member (50) will be described below with reference to FIGS. 2A to 3B. FIG. 2A is a sectional end view illustrating the first embodiment of the configuration of the movable scroll (26) and the floating member (50). FIG. 2A shows the movable scroll (26) and the floating member (50) when the movable scroll (26) does not tilt. FIG. 2B is an enlarged view of part (IIb) shown in FIG. 2A.

As illustrated in FIGS. 2A and 2B, the floating member (50) has an opposing surface (500). The opposing surface (500) is a surface that opposes to the back surface (270) of the movable end plate (27) of the movable scroll (26). The opposing surface (500) includes an inner portion (501) and an outer portion (502). Each of the inner portion (501) and the outer portion (502) is an annular portion about the drive shaft (40). The inner portion (501) is a portion of the opposing surface (500) located inward in the radial direction (X). The outer portion (502) is a portion of the opposing surface (500) located outward in the radial direction (X). The outer portion (502) is located inward of the inner portion (501) in the radial direction (X). The radial direction (X) is perpendicular to the axis of the main shaft portion (41) (see FIG. 1) of the drive shaft (40) of the scroll compressor (1).

The back surface (270) of the movable scroll (26) includes a first portion (271), a second portion (272), and a center portion (273). The first portion (271) faces the inner portion (501) of the floating member (50). The second portion (272) faces the outer portion (502) of the floating member (50). Each of the first portion (271) and the second portion (272) is an annular portion about the drive shaft (40). The second portion (272) is located outward of the first portion (271) in the radial direction (X). The center portion (273) is located inward of the first portion (271) in the radial direction (X). The drive shaft (40) is connected to the center portion (273).

The second portion (272) of the movable scroll (26) and the outer portion (502) of the floating member (50) have planes parallel to each other.

The first portion (271) of the movable scroll (26) has a plane flush with the second portion (272).

The inner portion (501) of the floating member (50) includes an inclined surface (501*a*) that is inclined to be separated from the first portion (271) of the movable scroll (26). In the first embodiment, the inclined surface (501*a*) of the inner portion (501) is inclined to be gradually separated from the first portion (271) in the axial direction (Y) as the inclined surface (501*a*) extends inward in the radial direction (X) (toward the drive shaft (40)).

Figure 3A:
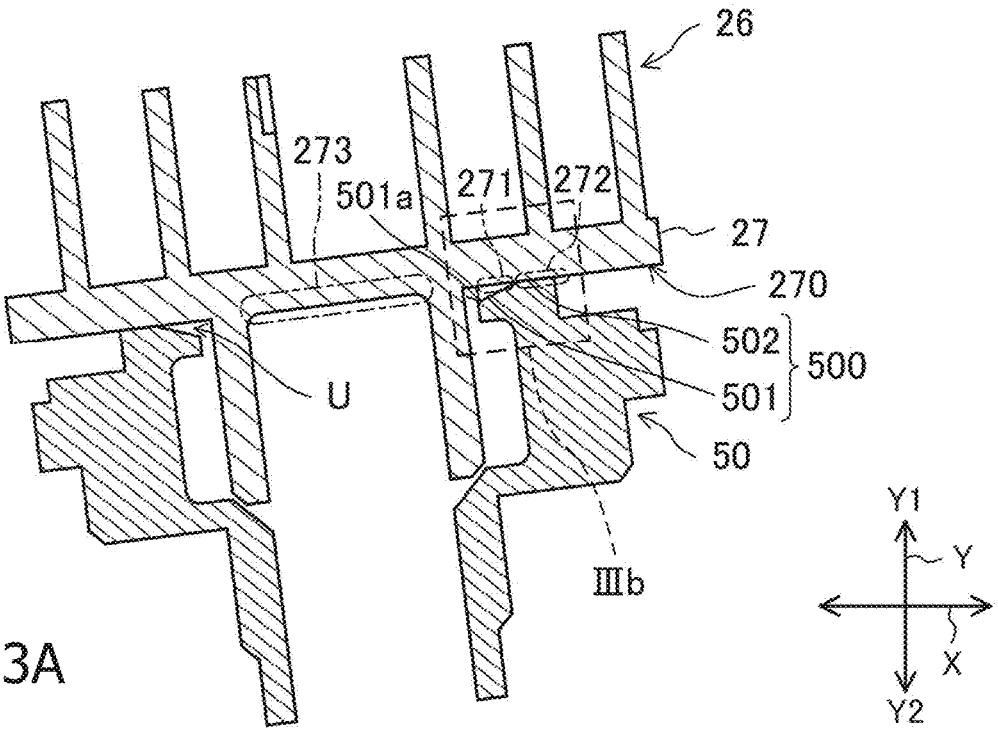
FIG. 3A is a sectional end view illustrating the movable scroll and the floating member when the movable scroll tilts.
Figure 3B:
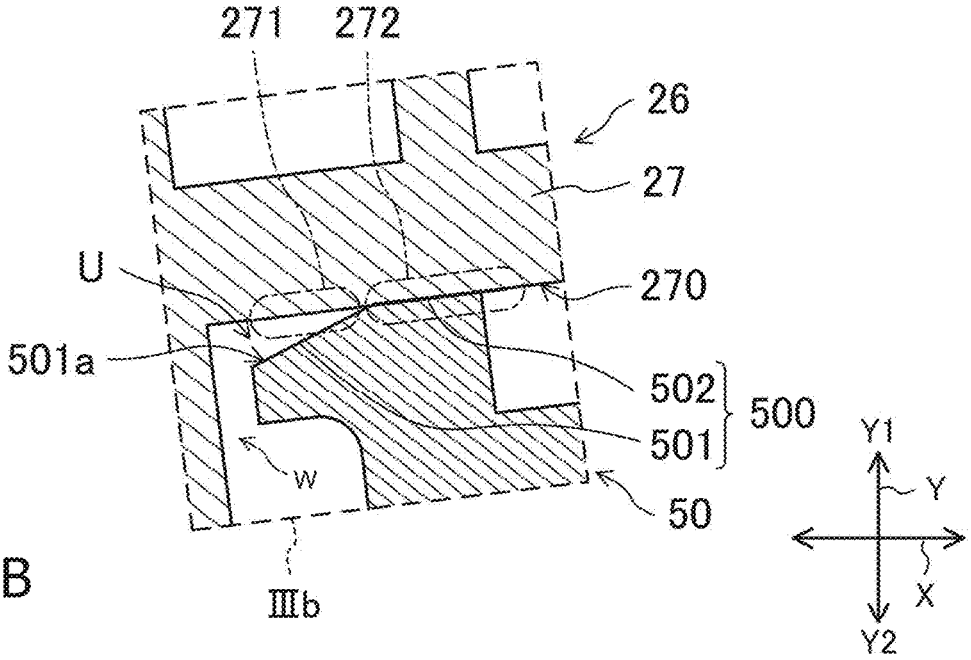
FIG. 3B is a partially enlarged view of FIG. 3A.

FIG. 3A is a sectional end view illustrating the movable scroll (26) and the floating member (50) when the movable scroll (26) tilts. FIG. 3B is an enlarged view of part (IIIb) shown in FIG. 3A.

As illustrated in FIGS. 3A and 3B, for example, when a refrigerant is injected into the compression chamber (S20) of the scroll compressor (1), the movable scroll (26) may tilt due to an increase in internal pressure of the compression chamber (S20).

When tilting, the movable scroll (26) is inclined with respect to the axial direction (Y) (the axis of the drive shaft (40)) as illustrated in FIGS. 2A and 3A. When the movable scroll (26) tilts, the floating member (50) is inclined to follow the tilt of the movable scroll (26). Although the floating member (50) follows the tilt of the movable scroll (26), and the outer portion (502) of the floating member (50) and the second portion (272) of the movable scroll (26) make surface contact with each other, a clearance (U) is kept present between the first portion (271) and the inclined surface (501*a*) of the floating member (50). The dimension of the clearance (U) in the axial direction (Y) gradually increases toward the center of the scroll compressor (1) (toward the drive shaft (40)).

The inclined surface (501*a*) is provided for the floating member (50) so that the clearance (U) is kept present although the outer portion (502) of the floating member (50) and the second portion (272) of the movable scroll (26) make surface contact with each other when the movable scroll (26) tilts and the floating member (50) is inclined to follow the tilt of the movable scroll (26). Thus, oil can be supplied through the clearance (U) to form an oil film between the movable scroll (26) and the floating member (50), avoiding poor lubrication. As a result, seizing of the contact portion between the movable scroll (26) and the floating member (50) can be reduced. This can keep the floating member (50) from impairing its function of supporting the movable scroll (26) when the movable scroll (26) tilts.

Figure 4A:
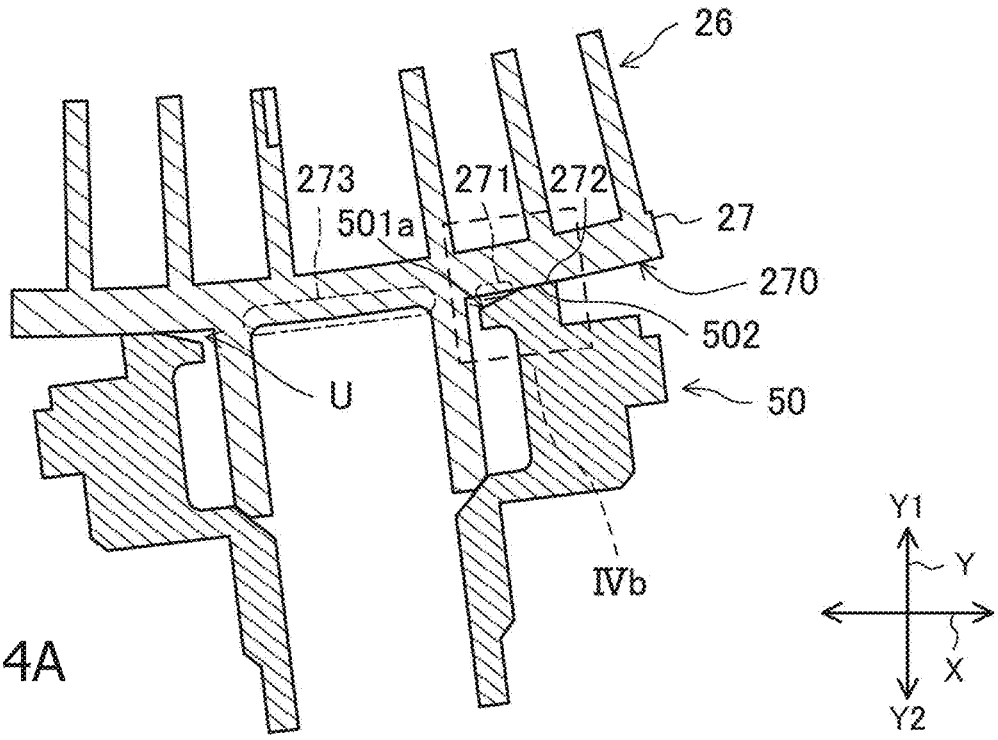
FIG. 4A is a sectional end view illustrating the movable scroll and the floating member when the movable scroll tilts and receives a gas load.
Figure 4B:
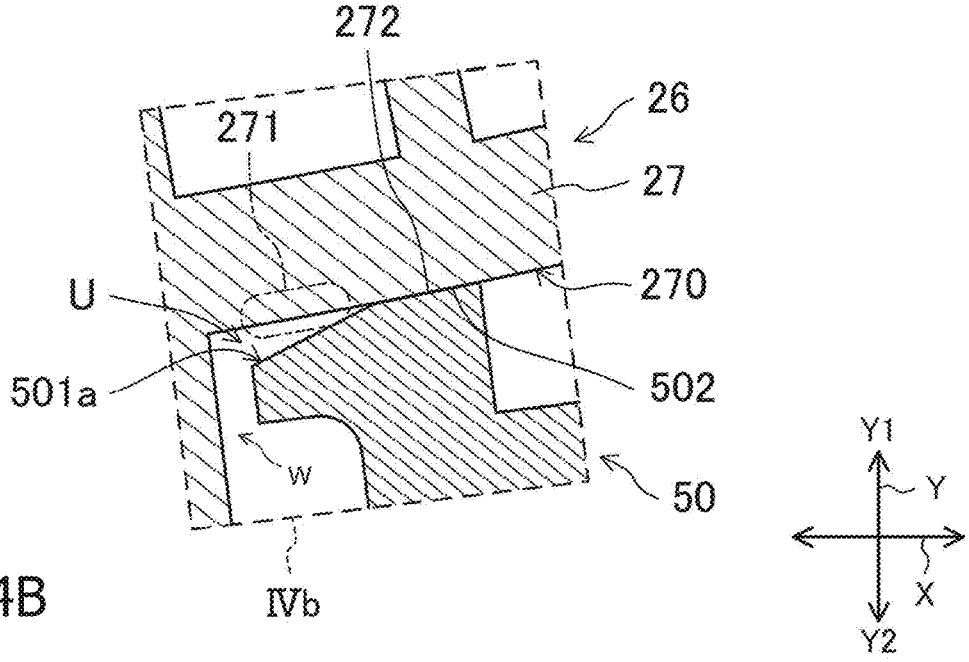
FIG. 4B is a partially enlarged view of FIG. 4A.

FIG. 4A is a sectional end view illustrating the movable scroll (26) and the floating member (50) when the movable scroll (26) tilts and receives a gas load (a load of the compressed refrigerant). FIG. 4B is an enlarged view of part (IVb) shown in FIG. 4A.

As illustrated in FIGS. 4A and 4B, when the movable scroll (26) tilts, the load of the compressed refrigerant (a gas load) may deform the movable scroll (26) by pressure and heat. In this case, the pressure and temperature of the refrigerant increase as the refrigerant goes toward the center portion (273) of the movable scroll (26), and the gas load acting on the movable scroll (26) increases as the gas goes toward the center portion (273) of the movable scroll (26). As a result, the gas load deforms the movable scroll (26). Specifically, the gas load causes the back surface (270) of the movable scroll (26) to curve, and the center portion (273) of the movable scroll (26) bulges toward the floating member (50).

When the gas load deforms the movable scroll (26), the outer portion (502) of the floating member (50) makes surface contact with the second portion (272) of the movable scroll (26), and is curved (deformed) along the second portion (272).

When the gas load deforms the movable scroll (26), the first portion (271) of the movable scroll (26) is curved toward the floating member (50), with a clearance (U) kept present between the first portion (271) and the inclined surface (501*a*) of the floating member (50). Thus, although the gas load deforms the movable scroll (26) when the movable scroll (26) tilts, oil can be supplied through the clearance (U) to form an oil film between the movable scroll (26) and the floating member (50). This can keep the floating member (50) from impairing its function of supporting the movable scroll (26).

Second Embodiment

Figure 5:
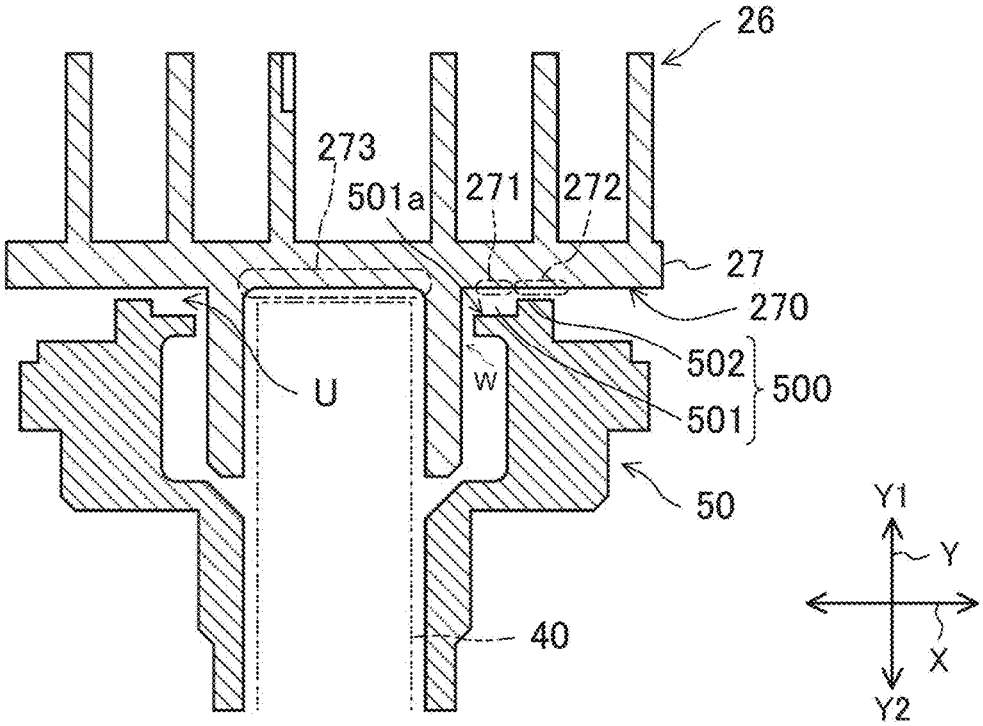
FIG. 5 is a sectional end view illustrating a second embodiment of the configuration of the movable scroll and the floating member.

Referring to FIG. 5, a second embodiment of the configuration of the movable scroll (26) and the floating member (50) will be described. FIG. 5 is a sectional view illustrating the second embodiment of the configuration of the movable scroll (26) and the floating member (50). FIG. 5 shows the movable scroll (26) and the floating member (50) when the movable scroll (26) does not tilt.

As illustrated in FIGS. 2A and 5, the second embodiment is different from the first embodiment in the configuration of the inner portion (501) of the floating member (50). Thus, differences from the first embodiment will be mainly described below.

As illustrated in FIG. 5, in the second embodiment, the inner portion (501) of the floating member (50) includes a step portion (501*b*). The step portion (501*b*) is spaced in a stepwise manner from the first portion (271) of the movable scroll (26). In the second embodiment, the step portion (501*b*) of the inner portion (501) is spaced in a stepwise manner from the first portion (271) in the axial direction (Y) as the step portion (501*b*) extends inward in the radial direction (X) (toward the drive shaft (40)). A clearance (U) is formed between the step portion (501*b*) and the first portion (271) of the movable scroll (26). The dimension of the clearance (U) in the axial direction (Y) increases in a stepwise manner toward the center of the scroll compressor (1). In the second embodiment, the step portion (501*b*) includes a single step, but the present invention is not limited to this example, and the step portion may include a plurality of steps.

With this configuration of the second embodiment, the clearance (U) can be kept present between the first portion (271) and the step portion (501*b*) of the floating member (50) when the floating member (50) follows the tilt of the movable scroll (26) as illustrated in FIG. 3A and when the movable scroll (26) is deformed by the gas load as illustrated in FIG. 4A. Thus, oil can be supplied through the clearance (U) to form an oil film between the movable scroll (26) and the floating member (50), keeping the floating member (50) from impairing its function of supporting the movable scroll (26).

Third Embodiment

Figure 6:
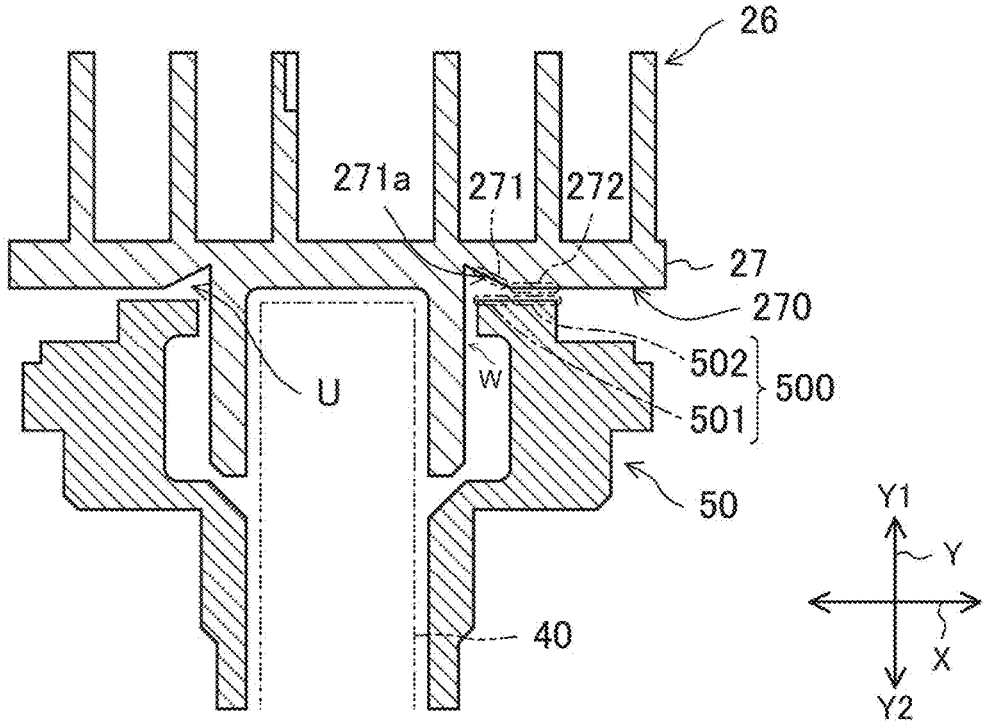
FIG. 6 is a sectional end view illustrating a third embodiment of the configuration of the movable scroll and the floating member.

Referring to FIG. 6, a third embodiment of the configuration of the movable scroll (26) and the floating member (50) will be described. FIG. 6 is a sectional end view illustrating the third embodiment of the configuration of the movable scroll (26) and the floating member (50). FIG. 6 shows the movable scroll (26) and the floating member (50) when the movable scroll (26) does not tilt.

As illustrated in FIGS. 2A and 6, the third embodiment is different from the first embodiment in the configuration of the inner portion (501) of the floating member (50) and the first portion (271) of the movable scroll (26). Thus, differences from the first embodiment will be mainly described below.

As illustrated in FIG. 6, the inner portion (501) of the floating member (50) includes a plane flush with the outer portion (502).

The first portion (271) of the movable scroll (26) includes an inclined surface (271*a*) that is inclined to be separated from the inner portion (501) of the floating member (50). In the third embodiment, the inclined surface (271*a*) of the first portion (271) is inclined to be gradually separated from the inner portion (501) in the axial direction (Y) as the inclined surface (271*a*) extends inward in the radial direction (X) (toward the drive shaft (40)). A clearance (U) is formed between the inclined surface (271*a*) and the inner portion (501) of the floating member (50). The dimension of the clearance (U) in the axial direction (Y) gradually increases toward the center of the scroll compressor (1).

With this configuration of the third embodiment, the clearance (U) can be kept present between the inclined surface (271*a*) of the first portion (271) and the floating member (50) when the floating member (50) follows the tilt of the movable scroll (26) as illustrated in FIG. 3A and when the movable scroll (26) is deformed by the gas load as illustrated in FIG. 4A. Thus, oil can be supplied through the clearance (U) to form an oil film between the movable scroll (26) and the floating member (50), keeping the floating member (50) from impairing its function of supporting the movable scroll (26).

Fourth Embodiment

Figure 7:
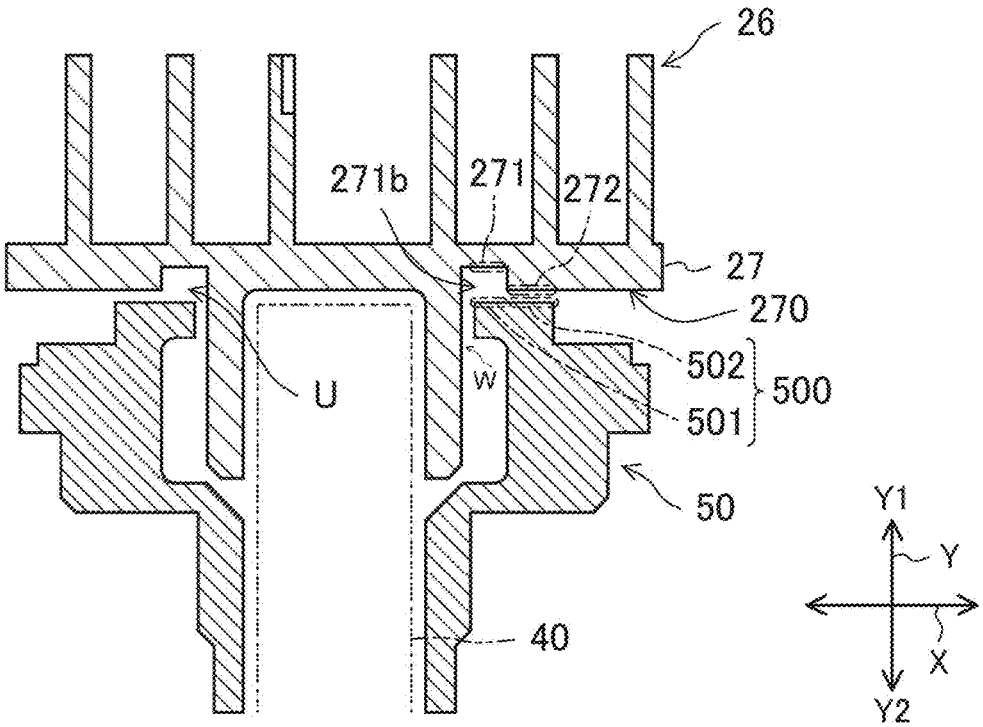
FIG. 7 is a sectional end view illustrating a fourth embodiment of the configuration of the movable scroll and the floating member.

Referring to FIG. 7, a fourth embodiment of the configuration of the movable scroll (26) and the floating member (50) will be described. FIG. 7 is a sectional end view illustrating the fourth embodiment of the configuration of the movable scroll (26) and the floating member (50). FIG. 7 shows the movable scroll (26) and the floating member (50) when the movable scroll (26) does not tilt.

As illustrated in FIGS. 6 and 7, the fourth embodiment is different from the third embodiment in the configuration of the first portion (271) of the movable scroll (26). Thus, differences from the third embodiment will be mainly described below.

As illustrated in FIG. 7, in the fourth embodiment, the first portion (271) of the movable scroll (26) includes a step portion (271*b*). The step portion (271*b*) is spaced in a stepwise manner from the inner portion (501) of the floating member (50). In the fourth embodiment, the step portion (271*b*) of the movable scroll (26) is spaced in a stepwise manner from the inner portion (501) in the axial direction (Y) as the step portion (271*b*) extends inward in the radial direction (X) (toward the drive shaft (40)). A clearance (U) is formed between the step portion (271*b*) and the inner portion (501) of the floating member (50). The dimension of the clearance (U) in the axial direction (Y) increases in a stepwise manner toward the center of the scroll compressor (1). In the fourth embodiment, the step portion (271*b*) includes a single step, but the present disclosure is not limited to this example, and the step portion may include a plurality of steps.

With this configuration of the fourth embodiment, the clearance (U) can be kept present between the step portion (271*b*) of the first portion (271) and the floating member (50) when the floating member (50) follows the tilt of the movable scroll (26) as illustrated in FIG. 3A and when the movable scroll (26) is deformed by the gas load as illustrated in FIG. 4A. Thus, oil can be supplied through the clearance (U) to form an oil film between the movable scroll (26) and the floating member (50), keeping the floating member (50) from impairing its function of supporting the movable scroll (26).

While the embodiments and the variations thereof have been described above, it will be understood that various changes in form and details may be made without departing from the spirit and scope of the claims (e.g., (1) below). The embodiments, the variations, and the other embodiments may be combined and replaced with each other without deteriorating intended functions of the present disclosure.

(1) The first portion (271) of the movable scroll (26) may have one of the step portion (271*b*) or the inclined surface (271*a*), and the inner portion (501) of the floating member (50) may have one of the inclined surface (501*a*) or the step portion (501*b*).

As described above, the present disclosure is useful for a scroll compressor and a refrigeration apparatus.

The invention claimed is:

1. A scroll compressor comprising:

a compression mechanism having a fixed scroll and a movable scroll; and a floating member supporting the movable scroll, the floating member including an opposing surface opposed to a back surface of the movable scroll, the back surface of the movable scroll including a first portion facing an inner portion of the opposing surface of the floating member, a second portion facing an outer portion of the opposing surface of the floating member, and a boss extending from the back surface toward the floating member in an axial direction of the compression mechanism, a space existing between an outer circumference of the boss and the floating member, and a clearance being present between the inner portion of the opposing surface and the first portion of the back surface, when the movable scroll tilts, the outer portion of the opposing surface and the second portion of the back surface making surface contact such that the clearance is kept present and an inner circumferential portion of the clearance is continuous with the space around an entire circumference of the clearance.

2. The scroll compressor of claim 1, wherein the clearance has a greater dimension than a gap between the outer portion and the second portion in the axial direction.

3. The scroll compressor of claim 1, wherein the inner portion of the opposing surface includes an inclined surface that is inclined to be separated from the first portion of the back surface.

4. The scroll compressor of claim 1, wherein the inner portion of the opposing surface includes a step portion that is separated in a stepwise manner from the first portion of the back surface.

5. The scroll compressor of claim 1, wherein the first portion of the back surface includes an inclined surface that is inclined to be separated from the inner portion of the opposing surface.

6. The scroll compressor of any one of claims 1, wherein the first portion of the back surface includes a step portion that is separated in a stepwise manner from the inner portion of the opposing surface.

7. The scroll compressor of claim 1, wherein the clearance between the opposing surface and the back surface increases gradually or in a stepwise manner toward a center of the scroll compressor.

8. The scroll compressor of claim 1, wherein when the second portion of the back surface is deformed, the outer portion of the opposing surface is deformed along the second portion.

9. A refrigeration apparatus including the scroll compressor of claim 1.

* * * * *